US006704941B1

(12) United States Patent
Palm

(10) Patent No.: US 6,704,941 B1
(45) Date of Patent: Mar. 16, 2004

(54) PEDICURE PROTECTION DEVICE

(76) Inventor: Donna M. Palm, 2269 Wheel Cog Pl., Woodbridge, VA (US) 22192

( * ) Notice: Subject to any disclaimer, the term of this patent is extended or adjusted under 35 U.S.C. 154(b) by 0 days.

(21) Appl. No.: 10/383,961

(22) Filed: Mar. 10, 2003

(51) Int. Cl.[7] ..... A41B 11/00
(52) U.S. Cl. ..... 2/239
(58) Field of Search ..... 2/239, 240, 241, 2/242, 409, 46, 159, 163, 245; D2/980, 989; 602/28, 4, 5, 23, 24; 604/24

(56) References Cited

U.S. PATENT DOCUMENTS 482,095 A * 9/1892 McClurg ..... 66/187
715,543 A * 12/1902 Bosworth ..... 2/239
730,366 A * 6/1903 Gunthorp ..... 36/179
1,498,829 A * 6/1924 Blum ..... 2/61
1,518,758 A * 12/1924 Rodee ..... 2/61
1,798,201 A * 3/1931 Hedges ..... 2/239
1,811,786 A * 6/1931 Frei ..... 66/187
1,999,929 A * 4/1935 Hearn ..... 2/239
2,327,836 A * 8/1943 Willard ..... 2/159
2,424,056 A * 7/1947 Ruth ..... 2/241
2,629,996 A * 3/1953 Hamilton ..... 66/172 R
3,017,640 A * 1/1962 Cardwell et al. ..... 2/239
3,128,763 A * 4/1964 Langenfeld et al. ..... 128/894
3,217,336 A * 11/1965 Wikler ..... 2/239
3,967,390 A * 7/1976 Anfruns ..... 36/94
4,017,987 A * 4/1977 Perez et al. ..... 36/11.5
4,181,982 A 1/1980 Segovia
4,207,880 A * 6/1980 Zinkovich ..... 602/30
4,295,647 A * 10/1981 Daly ..... 273/440
5,054,129 A * 10/1991 Baehr ..... 2/409
5,062,223 A * 11/1991 Johnson ..... 36/7.1 R
5,325,545 A * 7/1994 Hirano ..... 2/239
5,399,155 A * 3/1995 Strassburg et al. ..... 602/28
D375,195 S 11/1996 Panassidi
5,579,541 A * 12/1996 Christy et al. ..... 2/239
5,623,734 A * 4/1997 Pugliatti ..... 2/239
5,740,558 A * 4/1998 Messman ..... 2/239
5,749,100 A 5/1998 Rosenberg
5,774,898 A * 7/1998 Malpee ..... 2/239
5,867,838 A 2/1999 Corry
5,906,007 A 5/1999 Roberts
6,158,253 A * 12/2000 Svoboda et al. ..... 66/178 R
6,226,800 B1 * 5/2001 Islar ..... 2/239
6,334,222 B1 * 1/2002 Sun ..... 2/239
6,385,779 B2 * 5/2002 Boersema ..... 2/239
6,415,448 B1 * 7/2002 Glogover ..... 2/239
2002/0157169 A1 * 10/2002 Holloway ..... 2/239

* cited by examiner

*Primary Examiner*—John J. Calvert
*Assistant Examiner*—Alissa L. Hoey

(57) ABSTRACT

A pedicure and foot protection device includes a body including a heel portion and foot portion. A plurality of toe receiving conduits is attached to and extends away from the foot portion such that each one of a plurality of toes is insertable into the body and into the conduits. Each of the conduits has an open free end having a perimeter or perimeter edge. Each of a plurality of elastic bands is attached to and extends along one of the perimeters of the free ends.

4 Claims, 1 Drawing Sheet

PEDICURE PROTECTION DEVICE

BACKGROUND OF THE INVENTION

1. Field of the Invention

The present invention relates to pedicure protectors and more particularly pertains to a new pedicure protector for protecting the foot and toenails of a person receiving a pedicure.

2. Description of the Prior Art

The use of pedicure protectors is known in the prior art. U.S. Pat. No. 5,906,007 describes a sock having a plurality of toe sheaths which may be rolled up to expose the toenails of a person receiving a pedicure. Another type of related device is U.S. Pat. No. 5,867,838 having an open end for exposing the toes when a person wears sandals.

While these devices fulfill their respective, particular objectives and requirements, the need remains for a device that holds to the toes in a tight, but not restrictive manner so that the toes are exposed while the remainder of the foot is protected from debris and loss of heat.

SUMMARY OF THE INVENTION

The present invention meets the needs presented above by including toe conduits having elastic bands encircling an end of the conduit. The bands, both by their elastic nature and surface tension, ensure that the conduits remain in place on the toe and do not unwantedly slide over toenails.

Another object of the present invention is to provide a new pedicure protector that includes tabs attached to the elastic bands for easy movement of the bands on the toes.

To this end, the present invention generally comprises a body including a heel portion and foot portion. A plurality of toe receiving conduits is attached to and extends away from the foot portion such that each one of a plurality of toes is insertable into the body and into the conduits. Each of the conduits has an open free end having a perimeter or perimeter edge. Each of a plurality of elastic bands is attached to and extends along one of the perimeters of the free ends.

There has thus been outlined, rather broadly, the more important features of the invention in order that the detailed description thereof that follows may be better understood, and in order that the present contribution to the art may be better appreciated. There are additional features of-the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
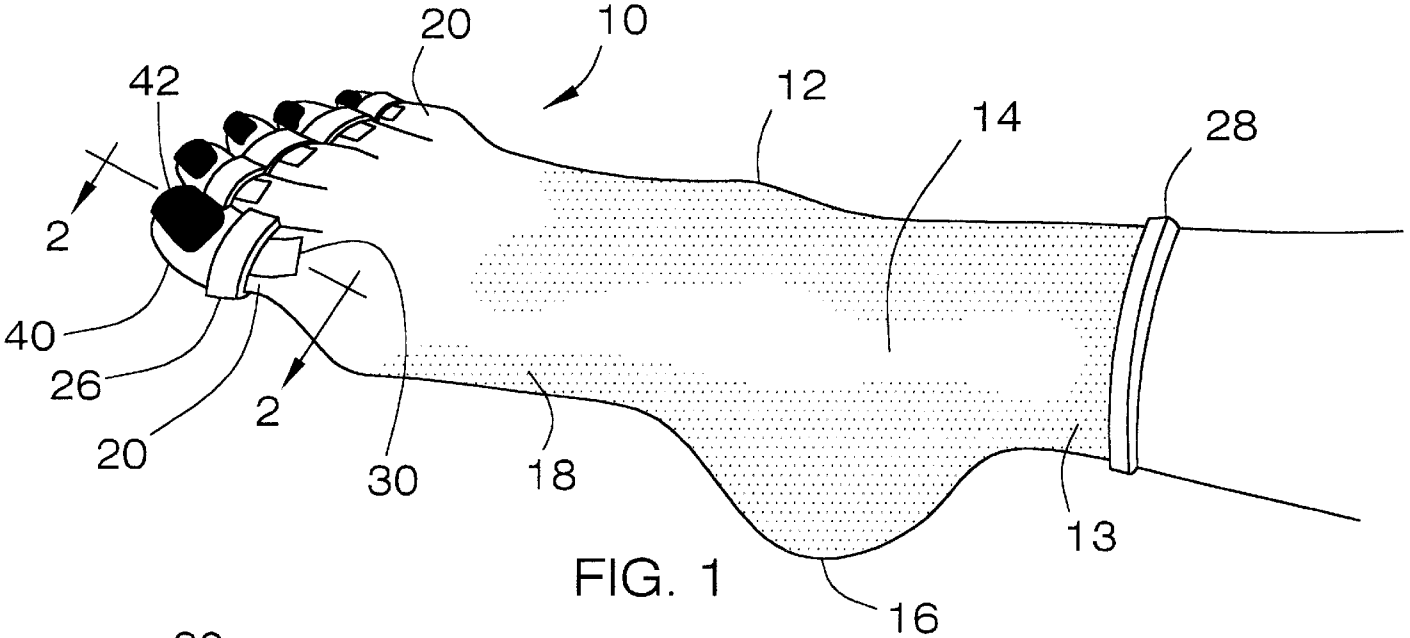
FIG. 1 is an in-use perspective view of a pedicure protection device according to the present invention.
Figure 2:
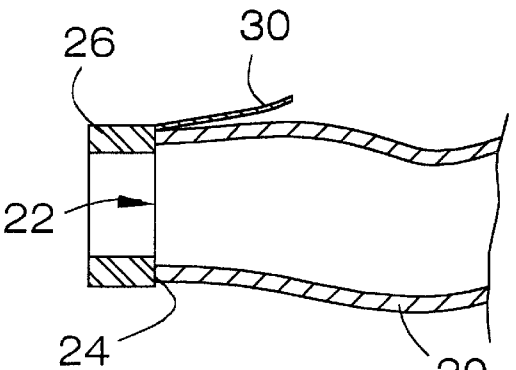
FIG. 2 is a cross-sectional view taken along line 2—2 of FIG. 1 the present invention.

With reference now to the drawings, and in particular to FIGS. 1 and 2 thereof, a new pedicure protector embodying the principles and concepts of the present invention and generally designated by the reference numeral 10 will be described.

As best illustrated in FIGS. 1 and 2, the pedicure protection device 10 generally includes a body 12 including a leg portion 13, an ankle portion 14, heel portion 16 and foot portion 18. The body 12 preferably comprises a resiliently stretchable cloth material which may be any conventional material used for socks such as cotton, nylon, or mixtures of these either with or without elastomeric threads woven therein.

The body 12 forms a sock having an end to which is attached a plurality of toe receiving conduits 20. The toe receiving conduits 20 extend away from the foot portion 12 such that each one of a plurality of toes 40 is insertable into the body 12 and into the conduits 20. Each of the conduits 20 has an open free end 22. Each of the free ends 22 has a perimeter 24 having one of a plurality of elastic bands 26 attached thereto and extending there along. Each of the bands 26 preferably comprises an elastomeric material. Preferably, a foot receiving band 28 is attached along a peripheral edge of the leg portion 13.

Preferably, each of a plurality of tabs 30 is attached to one of the elastic bands 26 such that each of the elastic bands 26has a tab 30 attached thereto. Each of the tabs 30 extends toward the body 12.

In use, the device 10 is positioned over a foot and the toes 40 extended through and outward of the conduits 20 such that each of the elastic bands 26 extends around one of the toes 40. The bands 26 hold the conduits 20 in place so that the conduits 20 do not move over the toenail 42 of the toe 40. Tabs 30 may be used in order to assist in the pulling of the bands 26 toward the body 12 and away from the toenail 42. The devices 10 are worn to keep the foot of the wearer clean and warm while receiving a pedicure as well as when walking to or from the pedicure.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot covering device for exposing toenails during a pedicure, said device comprising:

a body including a heel portion and foot portion;

a plurality of toe receiving conduits being attached to and extending away from said foot portion such that each one of a plurality of toes is insertable into said body and into said conduits, each of said conduits having an open free end, each of said free ends having a perimeter; and a plurality of elastic bands, each of said elastic bands being attached to and extended along one of said perimeters of said free ends, each of said elastic bands extending outwardly from said free ends, each of said elastic bands comprising an elastomeric material.

2. The foot covering device as in claim 1, further including a plurality of tabs, each of said tabs being attached to one of said elastic bands.

3. The foot covering device as in claim 2, wherein each of said tabs extends toward said body.

4. A foot covering device for exposing toenails during a pedicure, said device comprising:

a body including a leg portion, an ankle portion, heel portion and foot portion, said body comprising a resiliently stretchable cloth material;

a plurality of toe receiving conduits being attached to and extending away from said foot portion such that each one of a plurality of toes is insertable into said body and into said conduits, each of said conduits having an open free end, each of said free ends having a perimeter;

a plurality of elastic bands, each of said elastic bands being attached to and extended along one of said perimeters of said free ends, each of said bands extending away from said free ends, each of said bands comprising an elastomeric material; and a plurality of tabs, each of said tabs being attached to one of said elastic bands, each of said tabs extending toward said body.

* * * * *